US006764456B1

(12) United States Patent
Doherty

(10) Patent No.: US 6,764,456 B1
(45) Date of Patent: Jul. 20, 2004

(54) FOOT MASSAGING DEVICE

(76) Inventor: Thomas C. Doherty, 1105 Lexington St. #810, Waltham, MA (US) 02452

( * ) Notice: Subject to any disclaimer, the term of this patent is extended or adjusted under 35 U.S.C. 154(b) by 6 days.

(21) Appl. No.: 10/043,533

(22) Filed: Jan. 11, 2002

(51) Int. Cl.[7] ..... A61H 15/00
(52) U.S. Cl. ..... 601/121; 601/118
(58) Field of Search ..... 601/118, 121, 601/27, 128, 129, 19, 119, 120; 2/16, 125, 169; 128/856, 878; 602/63; 401/197; 15/230.11; 150/118–119

(56) References Cited

U.S. PATENT DOCUMENTS

| | | | | | |
|---|---|---|---|---|---|
| 1,481,038 | A | | 1/1924 | Stephenson | |
| 2,080,208 | A | | 5/1937 | Illch | |
| 2,325,867 | A | * | 8/1943 | Matsakas | 401/197 |
| 2,428,953 | A | * | 10/1947 | Adams | 492/29 |
| 2,434,462 | A | * | 1/1948 | Kempthorne | 15/230.11 |
| 2,775,280 | A | * | 12/1956 | Kasdan | 150/110 |
| 3,419,268 | A | * | 12/1968 | Bellet | 482/132 |
| 3,448,479 | A | * | 6/1969 | Cadermartori | 15/230.11 |
| 4,014,325 | A | | 3/1977 | Clarke | |
| 4,149,275 | A | * | 4/1979 | Sanchez | 2/269 |
| 4,257,140 | A | * | 3/1981 | Downing | 15/230.11 |
| 4,345,757 | A | * | 8/1982 | Lo Voi | 482/132 |
| 4,378,007 | A | | 3/1983 | Kachadourian | |
| 4,930,179 | A | * | 6/1990 | Wright et al. | 15/230.11 |
| 4,977,941 | A | * | 12/1990 | Henderson | 150/112 |
| 5,316,531 | A | * | 5/1994 | Spence | 482/106 |
| 5,411,470 | A | * | 5/1995 | Liptak et al. | 601/118 |
| 5,535,453 | A | * | 7/1996 | Howard | 2/269 |
| 5,598,596 | A | * | 2/1997 | Jones et al. | 15/1.52 |
| 5,749,098 | A | * | 5/1998 | Evans | 2/123 |
| 5,810,027 | A | * | 9/1998 | Frantzeskakis | 132/320 |
| D399,569 | S | | 10/1998 | Wier et al. | |
| 5,830,161 | A | | 11/1998 | Cosmano | |
| 6,098,240 | A | * | 8/2000 | Taylor | 15/230.11 |
| 6,382,376 | B1 | * | 5/2002 | Rosen et al. | 190/108 |
| 6,499,485 | B1 | * | 12/2002 | Pepera | 128/845 |

* cited by examiner

*Primary Examiner*—Michael A. Brown
*Assistant Examiner*—Fenn C. Matthew

(57) ABSTRACT

A foot massaging device for massaging a bottom of o foot of a user. The foot massaging device includes a body member being designed for being rolled between the foot of the user and a floor. A sleeve member has a perimeter wall defining an interior space of the sleeve member. The interior space of the sleeve member has an open end whereby the open end permits insertion of the body member into the interior space of the sleeve member. The sleeve member is designed for massaging the bottom of the foot of the user when the body member is rolled between the floor and the foot of the user.

10 Claims, 3 Drawing Sheets

FOOT MASSAGING DEVICE

BACKGROUND OF THE INVENTION

1. Field of the Invention

The present invention relates to foot massagers and more particularly pertains to a new foot massaging device for massaging a bottom of o foot of a user.

2. Description of the Prior Art

The use of foot massagers is known in the prior art. U.S. Pat. No. 5,830,161 describes a device for massaging the feet of a user. Another type of foot massagers is U.S. Pat. No. 2,080,208 having a body portion having resilient projections for massaging and exercising when the body portion is rolled under the foot of the user. U.S. Pat. No. 4,378,007 has an elongated symmetrical roller having studded base surfaces for massaging the foot of the user. U.S. Pat. No. 1,481,038 has a member having protuberances for messaging the foot of the user. U.S. Pat. No. 4,014,325 has a cylindrical member having a configured lateral surface for manipulating the foot and other extremities of the body. U.S. Pat. No. Des. 399,569 showing a foot massager.

While these devices fulfill their respective, particular objectives and requirements, the need remains for a device that has certain improved features allowing for the outer surface to be easily cleaned.

SUMMARY OF THE INVENTION

The present invention meets the needs presented above by providing a sleeve member that selectively receives the body member so that the sleeve member can be removed and washed in a washing machine.

Still yet another object of the present invention is to provide a new foot massaging device that provides varying types of massage for the foot of the user.

To this end, the present invention generally comprises a body member being designed for being rolled between the foot of the user and a floor. A sleeve member has a perimeter wall defining an interior space of the sleeve member. The interior space of the sleeve member has an open end whereby the open end permits insertion of the body member into the interior space of the sleeve member. The sleeve member is designed for massaging the bottom of the foot of the user when the body member is rolled between the floor and the foot of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
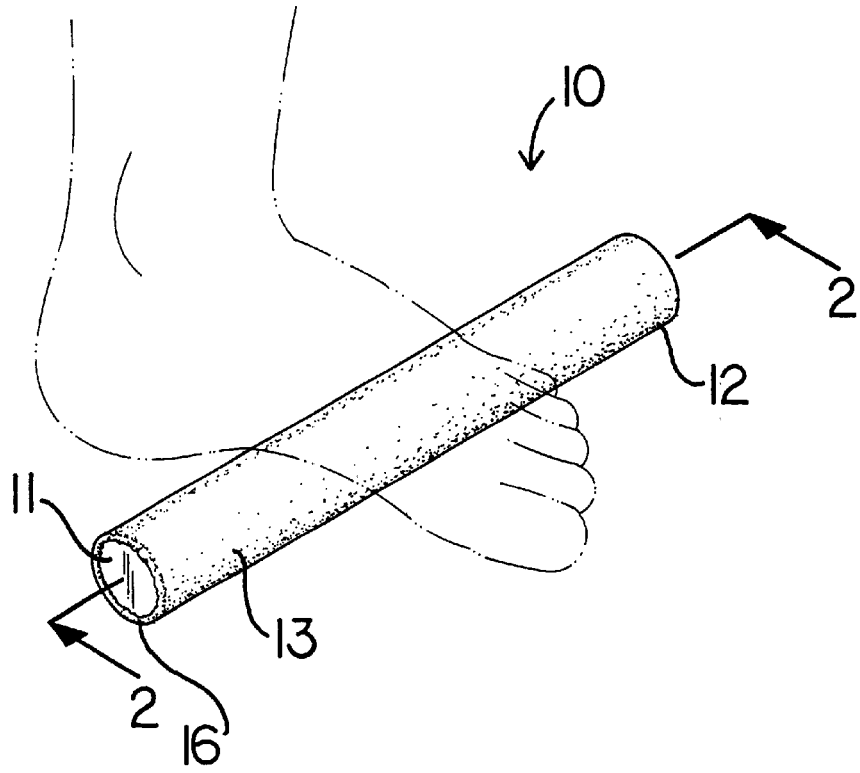
FIG. 1 is a perspective view of a new foot massaging device according to the present invention shown in use.
Figure 2:
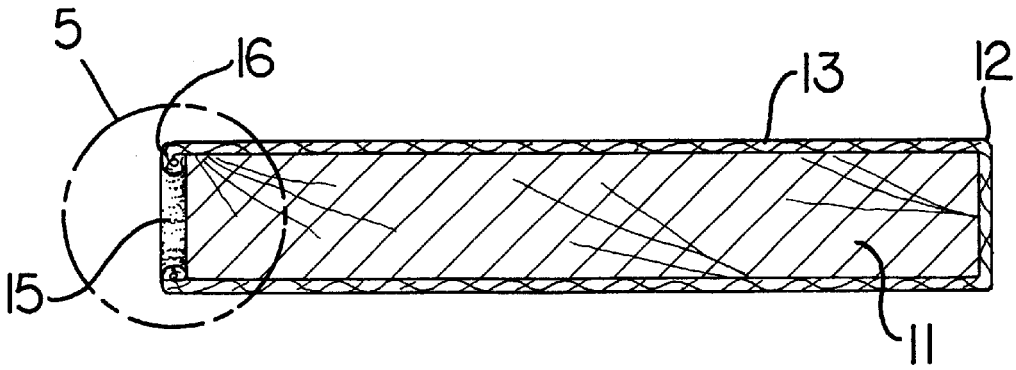
FIG. 2 is a cross-sectional view of the present invention taken along line 2—2 of FIG. 1.
Figure 3:
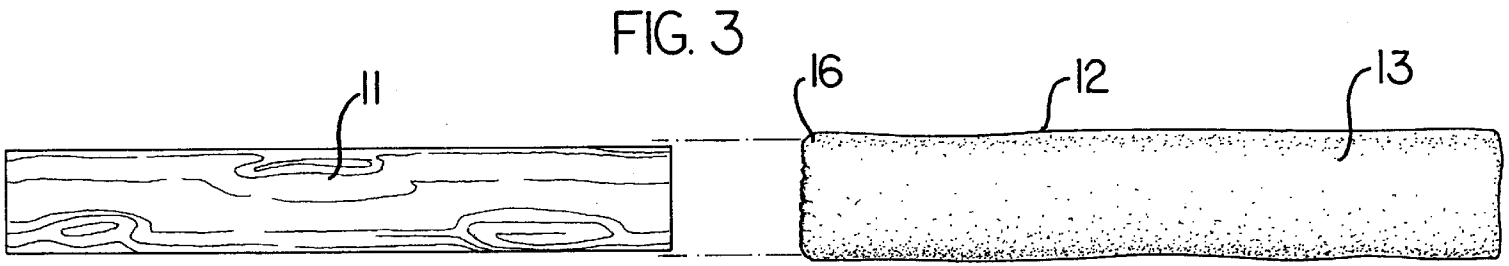
FIG. 3 is an exploded side view of the present invention.

With reference now to the drawings, and in particular to FIGS. 1 through 5 thereof, a new foot massaging device embodying the principles and concepts of the present invention and generally designated by the reference numeral 10 will be described.

As best illustrated in FIGS. 1 through 5, the foot massaging device 10 generally comprises a body member 11 being designed for being rolled between the foot of the user and a floor. The body member 11 comprises a rigid material. The rigid material is designed for providing positive pressure to the bottom of the foot of the user when the body member 11 is rolled between the floor and the foot of the user. The body member 11 has a length of about 12 inches and a diameter of about 1½ inches. Alternately the body member 11 can be provide with a length of about 18 inches.

A sleeve member 12 has a perimeter wall 13 defining an interior space 14 of the sleeve member 12. The interior space 14 of the sleeve member 12 has an open end 15 whereby the open end 15 permits insertion of the body member 11 into the interior space 14 of the sleeve member 12. The sleeve member 12 is designed for massaging the bottom of the foot of the user when the body member 11 is rolled between the floor and the foot of the user. The sleeve member 12 comprises a pliable material, such as fabric or a foamed material. The pliable material is designed for varying the pressure across the bottom of the foot of the user when the body member 11 is rolled between the floor and the foot of the user.

The sleeve member 12 has a receiving end 16. The receiving end 16 is positioned adjacent the open end 15 of the interior space 14 of the sleeve member 12. A first fastener member 17 is coupled to an interior surface of the perimeter wall 13 of the sleeve member 12 proximate the receiving end 16 of the sleeve member 12. A second fastener member 18 is coupled to the interior surface of the perimeter wall 13 of the sleeve member 12 proximate the first fastener member 17. The first fastener member 17 is complimentary to the second fastener member 18 such the receiving end 16 of the sleeve member 12 is folded inwards for reducing the area of the open end 15 of the interior space 14 for inhibiting inadvertent removal of the body member 11 from the interior space 14 of the sleeve member 12.

The first fastener member 17 comprises a first portion of hook and loop fastener 19. The second fastener member 18 comprises a second portion of hook and loop fastener 20. The first portion of hook and loop fastener 19 is complimentary to the second portion of hook and loop fastener 20 for selectively coupling the first portion of hook and loop fastener 19 to the second portion of hook and loop fastener 20.

Figure 4:
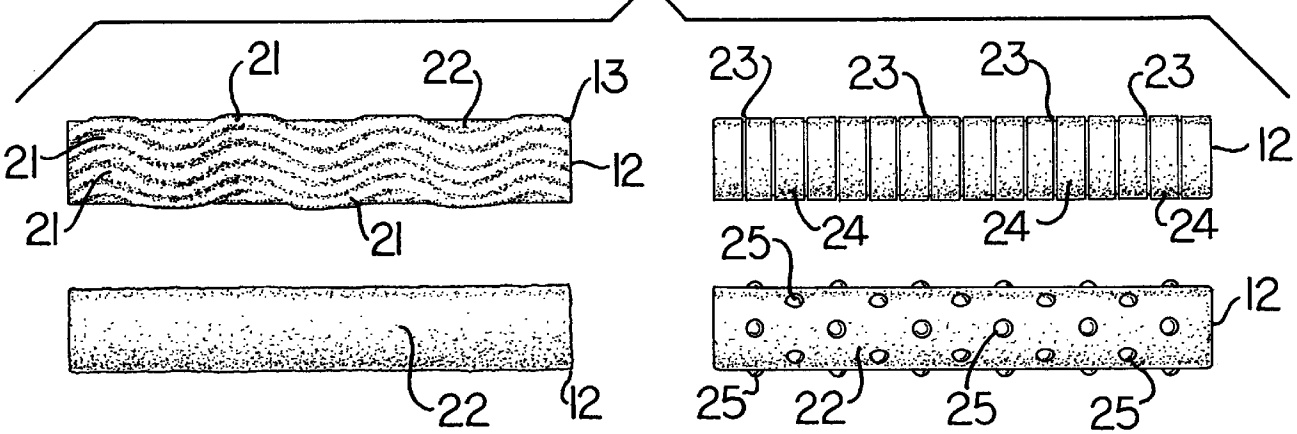
FIG. 4 is a front view of the embodiments of the sleeve member of the present invention.
Figure 5:
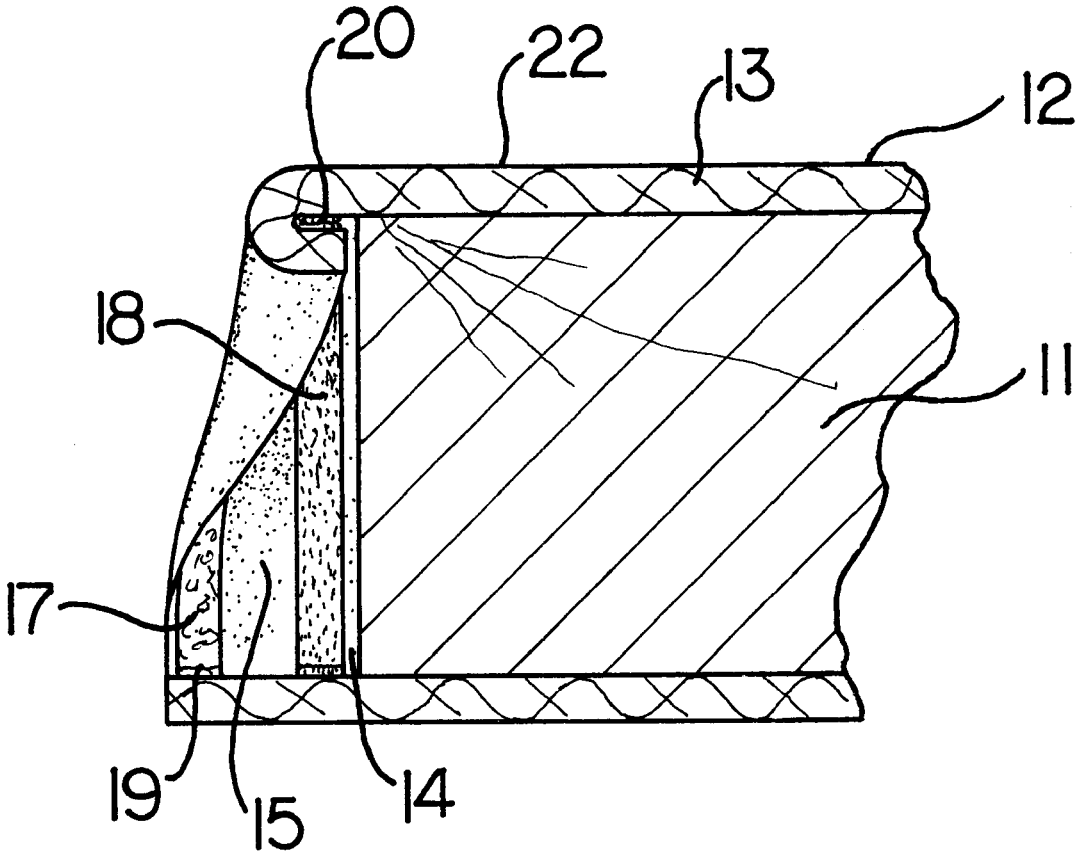
FIG. 5 is an enlarged cross-sectional view the present invention of the area designated 5 in FIG. 2.

Alternate embodiments of the sleeve member 12 can be provided, as shown in FIG. 4. The sleeve member 12 has a plurality of ribs 21. Each of the ribs 21 upwardly extends from an exterior surface 22 of the perimeter wall 13 of the sleeve member 12. The ribs 21 are designed for varying pressure applied to the bottom of the foot of the user when the body member 11 and the sleeve member 12 are rolled between the foot of the user and the floor. Each of the ribs 21 of the sleeve member 12 is substantially wavy for varying pressure applied to the bottom of the foot of the user. The sleeve member 12 has a plurality of channels 23. Each of the channels 23 annularly extends around the sleeve member 12 whereby the channels 23 define a plurality of raised portions 24 of the sleeve member 12. Each of the raised portions 24 is designed for varying the pressure applied to the bottom of the foot of the user. The sleeve member 12 has a plurality of nubs 25. Each of the nubs 25 is coupled to an exterior surface 22 of the perimeter wall 13 of the sleeve member 12. Each of the nubs 25 is designed for applying pressure to localized areas of the bottom of the foot of the user.

In use, the user places the body member 11 within said sleeve member 12. The first portion of hook and loop fastener 19 is coupled to the second portion of hook and loop fastener 20 to inhibit the body member 11 from sliding out of the sleeve member 12. The body member 11 and sleeve member 12 are then placed on the floor and the user uses the foot to roll the body member 11 and sleeve member 12 along the floor to massage the bottom of the foot.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot massaging device for massaging a bottom of a foot of a user, the foot massaging device comprising:

a body member being adapted for being rolled between the foot of the user and a floor;

a sleeve member having a perimeter wall defining an interior space of said sleeve member, said interior space of said sleeve member having an open end such that said open end permits insertion of said body member into said interior space of said sleeve member, said sleeve member being adapted for massaging the bottom of the foot of the user when said body member is rolled between the floor and the foot of the user, said perimeter wall being extending around the entirety of said interior space except said open end of said interior space such that said perimeter wall inhibits said body member being completely slid through said sleeve member when said body member inserted into said sleeve member;

said sleeve member having a receiving end, said receiving end being positioned adjacent said open end of said interior space of said sleeve member;

a first fastener member being coupled to an interior surface of said perimeter wall of said sleeve member proximate said receiving end of said sleeve member, a second fastener member being coupled to said interior surface of said perimeter wall of said sleeve member proximate said first fastener member, said first fastener member being complimentary to said second fastener member such that said receiving end of said sleeve member is folded inwards to reduce the area of said open end of said interior space to inhibit inadvertent removal of said body member from said interior space of said sleeve member; and said sleeve member having a plurality of ribs, each of said ribs upwardly extending from an exterior surface of said perimeter wall of said sleeve member, said ribs being adapted for varying pressure applied to the bottom of the foot of the user when said body member and said sleeve member is rolled between the foot of the user and the floor.

2. The massaging device as set forth in claim 1, further comprising:

said body member comprising a rigid material, said rigid material being adapted for providing positive pressure to the bottom of the foot of the user when said body member is rolled between the floor and the foot of the user.

3. The massaging device as set forth in claim 2, further comprising:

said sleeve member comprising a pliable material, said pliable material being adapted for varying the pressure across the bottom of the foot of the user when said body member is rolled between the floor and the foot of the user.

4. The massaging device as set forth in claim 1, further comprising:

said first fastener member comprising a first portion of hook and loop fastener, said second fastener member comprising a second portion of hook and loop fastener, said first portion of hook and loop fastener being complimentary to said second portion of hook and loop fastener for selectively coupling said first portion of hook and loop fastener to said second portion of hook and loop fastener.

5. The massaging device as set forth in claim 1, wherein each of said ribs of said sleeve member being substantially wavy for varying pressure applied to the bottom of the foot of the user.

6. A foot massaging device for massaging a bottom of a foot of a user, the foot massaging device comprising:

a body member being adapted for being rolled between the foot of the user and a floor;

a sleeve member having a perimeter wall defining an interior space of said sleeve member, said interior space of said sleeve member having an open end such that said open end permits insertion of said body member into said interior space of said sleeve member, said sleeve member being adapted for massaging the bottom of the foot of the user when said body member is rolled between the floor and the foot of the user, said perimeter wall being extending around the entirety of said interior space except said open end of said interior space such that said perimeter wall inhibits said body member being completely slid through said sleeve member when said body member inserted into said sleeve member;

said body member comprising a rigid material, said rigid material being adapted for providing positive pressure to the bottom of the foot of the user when said body member is rolled between the floor and the foot of the user;

said sleeve member comprising a pliable material, said pliable material being adapted for varying the pressure across the bottom of the foot of the user when said body member is rolled between the floor and the foot of the user;

said sleeve member having a receiving end, said receiving end being positioned adjacent said open end of said interior space of said sleeve member;

a first fastener member being coupled to an interior surface of said perimeter wall of said sleeve member proximate said receiving end of said sleeve member, a second fastener member being coupled to said interior surface of said perimeter wall of said sleeve member proximate said first fastener member, said first fastener member being complimentary to said second fastener member such that said receiving end of said sleeve member is folded inwards to reduce the area of said open end of said interior space to inhibit inadvertent removal of said body member from said interior space of said sleeve member; and said first fastener member comprising a first portion of hook and loop fastener, said second fastener member comprising a second portion of hook and loop fastener, said first portion of hook and loop fastener being complimentary to said second portion of hook and loop fastener for selectively coupling said first portion of hook and loop fastener to said second portion of hook and loop fastener; and said sleeve member having a plurality of ribs, each of said ribs upwardly extending from an exterior surface of said perimeter wall of said sleeve member, said ribs being adapted for varying pressure applied to the bottom of the foot of the user when said body member and said sleeve member is rolled between the foot of the user and the floor.

7. A foot massaging device for massaging a bottom of a foot of a user, the foot massaging device comprising:

a body member being adapted for being rolled between the foot of the user and a floor;

a sleeve member having a perimeter wall defining an interior space of said sleeve member, said interior space of said sleeve member having an open end such that said open end permits insertion of said body member into said interior space of said sleeve member, said sleeve member being adapted for massaging the bottom of the foot of the user when said body member is rolled between the floor and the foot of the user, said perimeter wall being extending around the entirety of said interior space except said open end of said interior space such that said perimeter wall inhibits said body member being completely slid through said sleeve member when said body member inserted into said sleeve member;

said sleeve member having a receiving end, said receiving end being positioned adjacent said open end of said interior space of said sleeve member;

a first fastener member being coupled to an interior surface of said perimeter wall of said sleeve member proximate said receiving end of said sleeve member, a second fastener member being coupled to said interior surface of said perimeter wall of said sleeve member proximate said first fastener member, said first fastener member being complimentary to said second fastener member such that said receiving end of said sleeve member is folded inwards to reduce the area of said open end of said interior space to inhibit inadvertent removal of said body member from said interior space of said sleeve member; and said sleeve member having a plurality of nubs, each of said nubs being coupled to an exterior surface of said perimeter wall of said sleeve member, each of said nubs being adapted for applying pressure to localized areas of the bottom of the foot of the user.

8. The massaging device as set forth in claim 7, further comprising:

said body member comprising a rigid material, said rigid material being adapted for providing positive pressure to the bottom of the foot of the user when said body member is rolled between the floor and the foot of the user.

9. The massaging device as set forth in claim 8, further comprising:

said sleeve member comprising a pliable material, said pliable material being adapted for varying the pressure across the bottom of the foot of the user when said body member is rolled between the floor and the foot of the user.

10. The massaging device as set forth in claim 7, further comprising:

said first fastener member comprising a first portion of hook and loop fastener, said second fastener member comprising a second portion of hook and loop fastener, said first portion of hook and loop fastener being complimentary to said second portion of hook and loop fastener for selectively coupling said first portion of hook and loop fastener to said second portion of hook and loop fastener.

* * * * *